US010895066B2

(12) United States Patent
Huang

(10) Patent No.: US 10,895,066 B2
(45) Date of Patent: Jan. 19, 2021

(54) TUBE-IN-TUBE PULL-OUT FAUCET

(71) Applicant: Flowtech Kitchen & Bathroom Technology Co., Ltd, Guangdong (CN)

(72) Inventor: Weixin Huang, Guangdong (CN)

(73) Assignees: FLOWTECH KITCHEN & BATHROOM, Guangdong (CN); TECHNOLOGY CO., LTD, Guangdong (CN)

( * ) Notice: Subject to any disclaimer, the term of this patent is extended or adjusted under 35 U.S.C. 154(b) by 0 days.

(21) Appl. No.: 16/345,541

(22) PCT Filed: Dec. 3, 2018

(86) PCT No.: PCT/CN2018/118945
§ 371 (c)(1),
(2) Date: Apr. 26, 2019

(87) PCT Pub. No.: WO2020/077759
PCT Pub. Date: Apr. 23, 2020

(65) Prior Publication Data

US 2020/0123741 A1 Apr. 23, 2020

(30) Foreign Application Priority Data

Oct. 17, 2018 (CN) ..... 2018 1 1208975

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
See application file for complete search history.

(56) References Cited

U.S. PATENT DOCUMENTS 2,971,520 A * 2/1961 Motis ..... A47L 17/00 134/172
7,162,782 B1 * 1/2007 Nelson ..... E03C 1/0404 29/225

(Continued)

FOREIGN PATENT DOCUMENTS

CN 105697812 A 6/2016

*Primary Examiner* — Jessica Cahill
*Assistant Examiner* — Patrick C Williams
(74) *Attorney, Agent, or Firm* — Muncy, Geissler, Olds & Lowe, P.C.

(57) ABSTRACT

The invention provides a tube-in-tube pull-out faucet which comprises a faucet body and an outer tube fixed to the faucet body, and further comprises a tube-in-tube pull-out device located above the faucet body, wherein the tube pull-out device comprises an inner tube joint, an inner tube joint nut, an inner tube, a first spring bracket, a first pull-out tube joint, a pull-out tube and a telescopic spring which are disposed in a cavity of the outer tube, one end of the inner tube joint is sleeved on the faucet body or the outer tube and the other end thereof is screwed to the inner tube joint nut, the inner tube joint is provided with an integrally formed joint portion, and an outer side wall of the joint portion is in sliding fit with an inner side wall of one end of the inner tube. Compared with the prior art, the invention can reduce the interference with many parts or even difficulty in pulling due to the tube-in-tube pull-out device disposed above the faucet body, has the advantages of convenience and smoothness in pull-out and low cost, can be conveniently and quickly replaced after sale, can be rotated by 360 degrees and is convenient to use.

6 Claims, 6 Drawing Sheets

(56) References Cited

U.S. PATENT DOCUMENTS

| | | | | |
|---|---|---|---|---|
| 8,713,725 | B2 * | 5/2014 | Alder | E03C 1/0404 4/678 |
| 2006/0130907 | A1 * | 6/2006 | Marty | E03C 1/0404 137/613 |
| 2016/0083942 | A1 * | 3/2016 | Li | E03C 1/0404 4/678 |

* cited by examiner

TUBE-IN-TUBE PULL-OUT FAUCET

FIELD OF THE INVENTION

The invention belongs to the technical field of faucet apparatuses and relates to a tube-in-tube pull-out faucet.

BACKGROUND OF THE INVENTION

At present, in the prior art, Patent Document CN201610180175.4 discloses an integrated pull-out water-filtration faucet which comprises a faucet body, a water discharge tube, a filter element and a water valve, wherein the faucet body has a vertical tube portion which is internally provided with a vertical pull-out passage, a central axis of the pull-out passage is located at one side of a central axis of the vertical tube portion, a bottom end of the vertical tube portion is a water inlet end, a top port of the vertical tube portion is connected with the water discharge tube, sides of the vertical tube portion have a filtering interface and a water valve interface for mounting the filter element and the water valve respectively, a cold water passage, a hot water passage and a return passage are arranged at the water inlet end of the vertical tube portion, the cold water passage and the hot water passage extend to the water valve interface for mixing, the water valve interface is provided with a mixed water flow channel and extends to the filtering interface for filtering, the filtering interface is provided with a return port and extends to the water inlet end to form the return passage which is connected with the pull-out tube, and the pull-out tube passes through the pull-out passage in the vertical tube portion and extends to the water discharge tube to form a pull-out water-discharge structure. Although the above structure can achieve the pull-out of the tube, such pull-out relies on components such as a gravity hammer disposed below the faucet body, and there are the problems that many components are disposed below the faucet body, resulting in a complicated structure, and the interference of the tube with other components or even getting stuck easily occurs during the pull-out of the tube, causing inconvenience to users.

For this reason, the invention provides a tube-in-tube pull-out faucet.

SUMMARY OF THE INVENTION

In view of the above problems existing in the prior art, an object of the invention is to provide a tube-in-tube pull-out faucet which can reduce the interference with many parts or even difficulty in pulling during pull-out due to no need to pull an inner tube from a lower end, has the advantages of convenience and smoothness in pull-out, can be rotated by 360 degrees and is convenient to use.

The object of the invention can be achieved by the following technical solution.

A tube-in-tube pull-out faucet comprises a faucet body and an outer tube fixed to the faucet body, and further comprises a tube-in-tube pull-out device located above the faucet body, wherein the tube pull-out device comprises an inner tube joint, an inner tube joint nut, an inner tube, a first spring bracket, a first pull-out tube joint, an intermediary pull-out tube and a telescopic spring which are disposed in a cavity of the outer tube, one end of the inner tube joint is sleeved on the faucet body or the outer tube and the other end thereof is screwed to the inner tube joint nut, the inner tube joint is provided with an integrally formed joint portion, an outer side wall of the joint portion is in sliding fit with an inner side wall of one end of the inner tube, the other end of the inner tube is sequentially passed through the first spring bracket and the first pull-out tube joint and arranged in the pull-out tube, the first spring bracket is arranged above the inner tube joint nut, the first pull-out tube joint is sleeved in the inner tube joint nut, one end of the pull-out tube is movably sleeved on the pull-out tube joint, the telescopic spring is wound around an outer side wall of the pull-out tube, one end of the telescopic spring is fixed on the first spring bracket, the other end of the pull-out tube is screwed with a second pull-out joint, one end of the second pull-out joint is communicated with one end of the inner tube, the other end of the second pull-out joint is in screwed communication with a pull-out water-discharge head which is movably sleeved in the outer tube, a second spring bracket is sleeved on outer side walls of the second pull-out joint and the pull-out water-discharge head, and the other end of the telescopic spring is fixed to the second spring bracket.

Further, the tube-in-tube pull-out faucet further comprises a low-pressure sealing ring and a back-pressure oil seal ring which are sleeved on an outer side wall of the inner tube, wherein the back-pressure oil seal ring is arranged above the low-pressure sealing ring, and the low-pressure sealing ring and the back-pressure oil seal ring are located in the first spring bracket.

Further, the tube-in-tube pull-out faucet further comprises a first sealing ring, a second sealing ring and a third sealing ring, wherein the first sealing ring and the third sealing ring are clamped on an inner wall of the outer tube in a spaced manner, and the second sealing ring is sleeved on the inner tube joint nut and located between the first sealing ring and the third sealing ring.

Further, the inner tube is made of a polyamide (PA) material (or similar).

Further, the outer tube, the inner tube and the pull-out tube are U-shaped.

As described above, the tube-in-tube pull-out faucet involved in the invention has the following beneficial effects:

By utilizing the above tube-in-tube pull-out faucet, compared with the prior art, the invention can reduce the interference with many parts or even difficulty in pulling during pull-out due to no need to pull the inner tube from the lower end by means of the tube-in-tube pull-out device arranged above the faucet body in combination with the tube-in-tube structure consisting of the outer tube, the pull-out tube and the inner tube, has the advantages of convenience and smoothness in pull-out, a simple structure and low cost, can be replaced as a whole when needed, can be conveniently and quickly repaired with high efficiency after sale, can be rotated by 360 degrees and is convenient to use and also eliminates the requirement of the previous art in that the pull out tube does not protrude below the mounting flange of the faucet and is all contained within the faucet body and spout.

The invention will be further described below in conjunction with particular embodiments.

DESCRIPTION OF REFERENCE NUMERALS OF ELEMENTS

Figure 1:
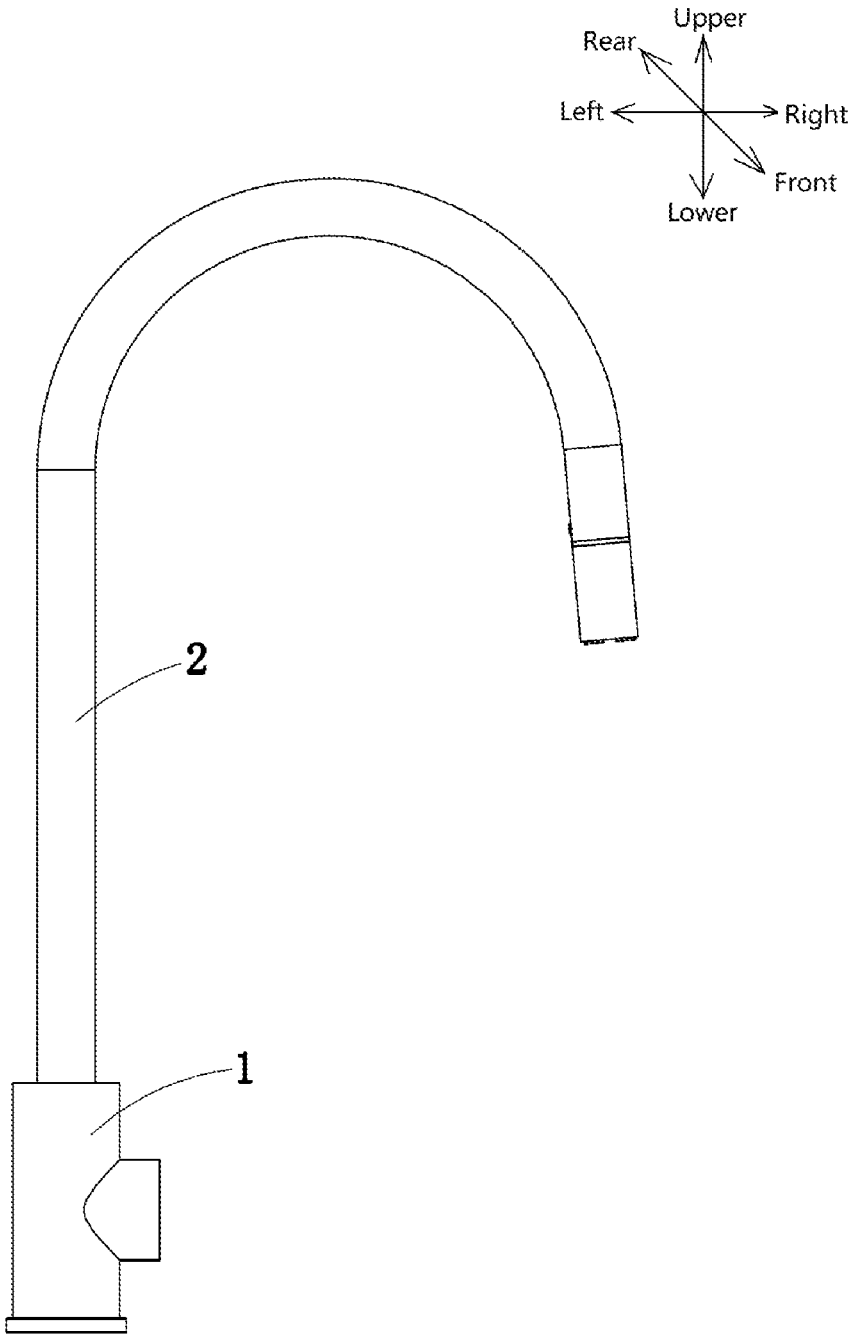
FIG. 1 is a front view of a tube-in-tube pull-out faucet.
Figure 2:
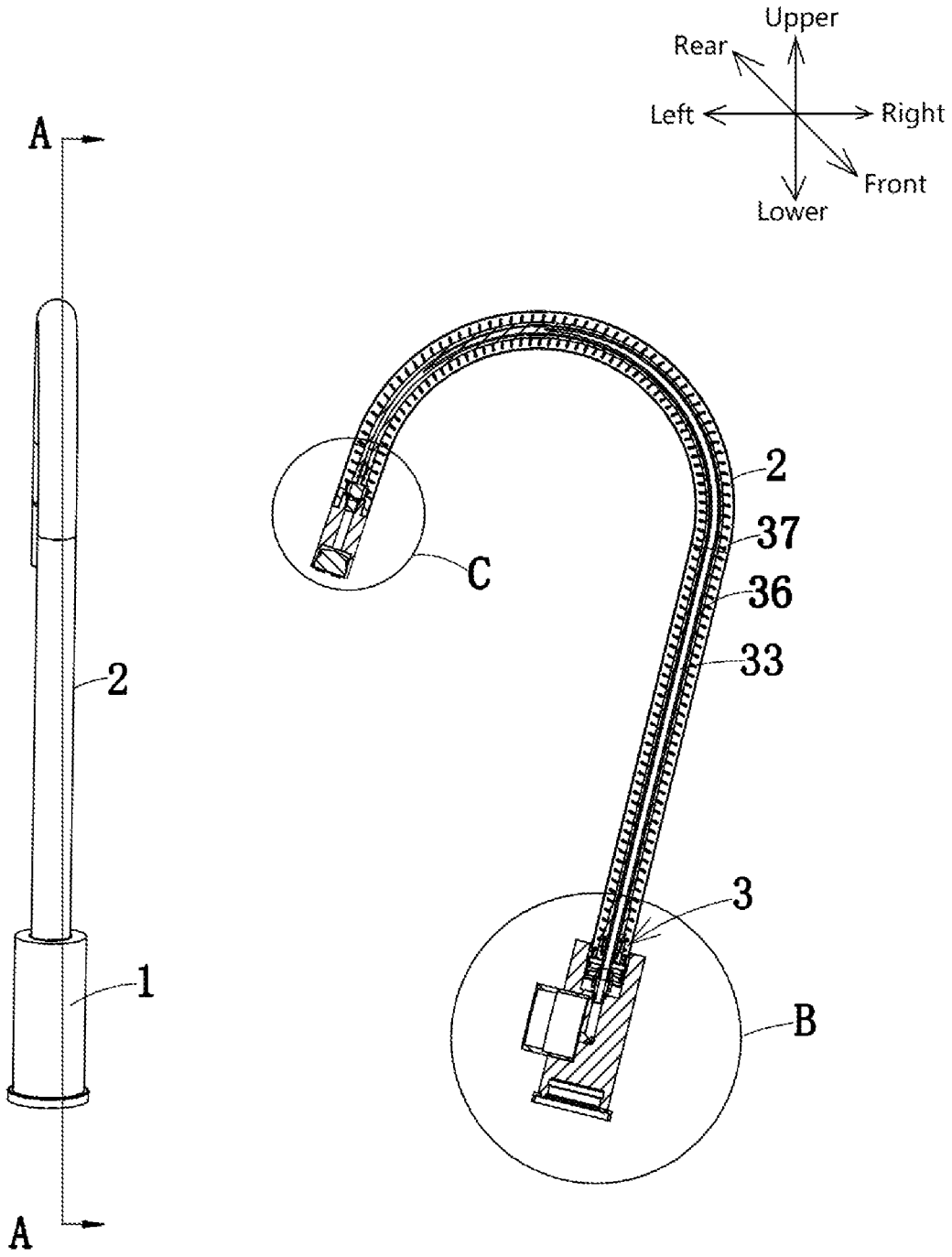
FIG. 2 is a structural view of a tube-in-tube pull-out faucet taken from another angle and an A-A sectional view at this viewing angle.

| | |
|---|---|
| 1 | Faucet body |
| 2 | Outer tube |
| 3 | Tube-in-tube pull-out device |
| 31 | Inner tube joint |
| 32 | Inner tube joint nut |
| 33 | Inner tube |
| 34 | First spring bracket |
| 35 | First pull-out tube joint |
| 36 | Pull-out tube |
| 37 | Telescopic spring |
| 38 | Second pull-out joint |
| 39 | Second spring bracket |
| 4 | Pull-out water-discharge head |
| 5 | Low-pressure sealing ring |
| 6 | Back-pressure oil seal ring |
| 7 | First sealing ring |
| 8 | Second sealing ring |
| 9 | Third sealing ring |

DETAILED DESCRIPTION OF THE INVENTION

The embodiments of the invention will be described below by specific particular embodiments, and the persons skilled in the art can readily know other advantages and effects of the invention from the disclosures of the present description.

It should be understood that the structures, proportions, sizes and the like illustrated in the drawings of the specification are only used in combination with the disclosures of the present description for the purpose of understanding and reading by the persons skilled in the art, and are not intended to limit the implementability of the invention, and therefore do not have any technical significance. Any structural modification, change in the proportional relation or size adjustment should fall within the scope that can be covered by the technical contents disclosed in the invention without affecting the effects and objects achievable by the invention. Moreover, the terms such as "upper", "lower", "left", "right", "intermediate" and "one" used in the present description are also merely for the sake of description and clarity and are not intended to limit the implementable scope of the invention, and the change or adjustment in the relative relation should also be considered within the implementable scope of the invention without substantial changes in the technical contents. The specific structures can be described with reference to the drawings of the patent application.

In the following embodiments, the directions are defined by the arrow directions in FIG. 1 of the paper, the left side of the paper is the left direction, the right side of the paper is the right direction, the upper side of the paper is the upper direction, the lower side of the paper is the lower direction, the front side perpendicular to the paper is the front direction, the rear side perpendicular to the paper is the rear direction, the cavity of the faucet body is the inside and the outer side wall of the faucet body is the outside.

As shown in FIGS. 1, 2, 3, 4, 5 and 6, a tube-in-tube pull-out faucet comprises a faucet body 1 and an outer tube 2 fixed to the faucet body 1, and further comprises a tube-in-tube pull-out device 3 located above the faucet body 1, wherein the tube pull-out device 3 comprises an inner tube joint 31, an inner tube joint nut 32, an inner tube 33, a first spring bracket 34, a first pull-out tube joint 35, a stretchable pull-out tube 36 and a telescopic spring 37 which are disposed in a cavity of the outer tube 2, one end of the inner tube joint 31 is sleeved on the faucet body 1 or the outer tube 2 and the other end thereof is screwed to the inner tube joint nut 32, the inner tube joint 31 is provided with an integrally formed joint portion, an outer side wall of the joint portion is in sliding fit with an inner side wall of one end of the inner tube 33, the other end of the inner tube 33 is sequentially passed through the first spring bracket 34 and the first pull-out tube joint 35 and arranged in the pull-out tube 36, the first spring bracket 34 is arranged above the inner tube joint nut 32, the first pull-out tube joint 35 is sleeved in the inner tube joint nut 32, one end of the pull-out tube 36 is movably sleeved on the first pull-out tube joint 35, the telescopic spring 37 is wound around an outer side wall of the pull-out tube 36, one end of the telescopic spring 37 is fixed on the first spring bracket 34, the other end of the pull-out tube 36 is screwed with a second pull-out joint 38, one end of the second pull-out joint 38 is communicated with one end of the inner tube 33, the other end of the second pull-out joint 38 is in screwed communication with a pull-out water-discharge head 4 which is movably sleeved in the outer tube 2, a second spring bracket 39 is sleeved on outer side walls of the second pull-out joint 38 and the pull-out water-discharge head 4, and the other end of the telescopic spring 37 is fixed to the second spring bracket 39. By utilizing such structure, compared with the prior art, the invention can reduce the interference with many parts or even difficulty in pulling during pull-out due to no need to pull the inner tube 33 from below the faucet by means of the tube-in-tube pull-out device 3 arranged above the faucet body 1 in combination with the tube-in-tube structure consisting of the outer tube 2, the pull-out tube 36 and the inner tube 33, has the advantages of convenience and smoothness in pull-out, a simple structure and low cost, can be replaced as a whole when needed, can be conveniently and quickly repaired with high efficiency after sale, can be rotated by 360 degrees and is convenient to use and has no pull out tube protruding below the faucet mounting as all the pull out tubes and mechanism are mounted within the spout.

Figure 3:
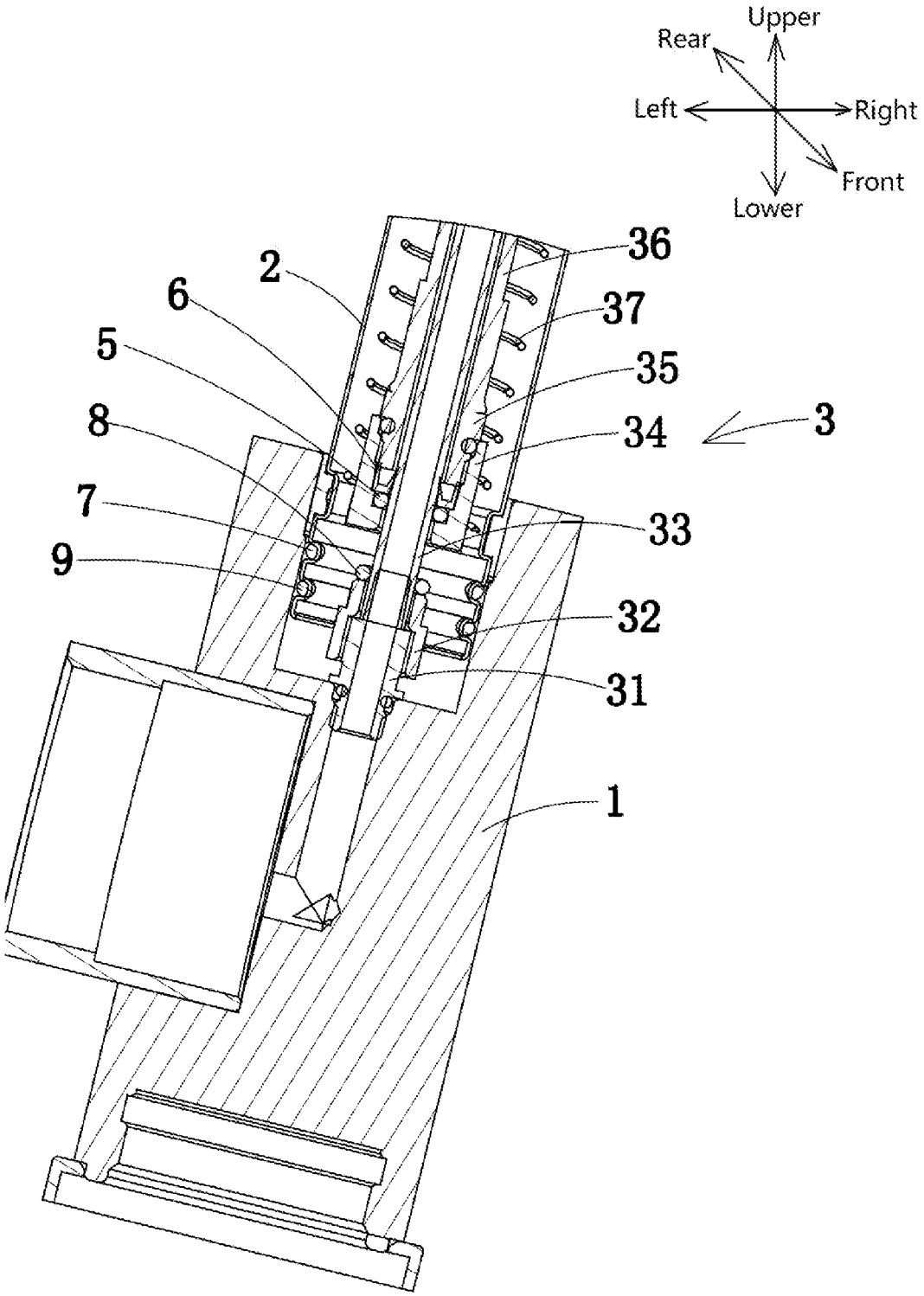
FIG. 3 is an enlarged sectional structural view of part B of a tube-in-tube pull-out faucet.

Further, in order to improve the airtightness, as shown in FIG. 3, the tube-in-tube pull-out faucet further comprises a low-pressure sealing ring 5 and a back-pressure oil seal ring 6 which are sleeved on an outer side wall of the inner tube 33, wherein the back-pressure oil seal ring 6 is arranged above the low-pressure sealing ring 5, and the low-pressure sealing ring 5 and the back-pressure oil seal ring 6 are located in the first spring bracket 34. In this way, the airtightness is improved and water leakage can be avoided. In addition, when the pull-out tube 36 is released for backlash, the arrangement of the back-pressure oil seal ring 6 can effectively counteract the impact force and can reduce the wear of the first spring bracket 34, thereby prolonging the service life and reducing the maintenance cost.

Figure 4:
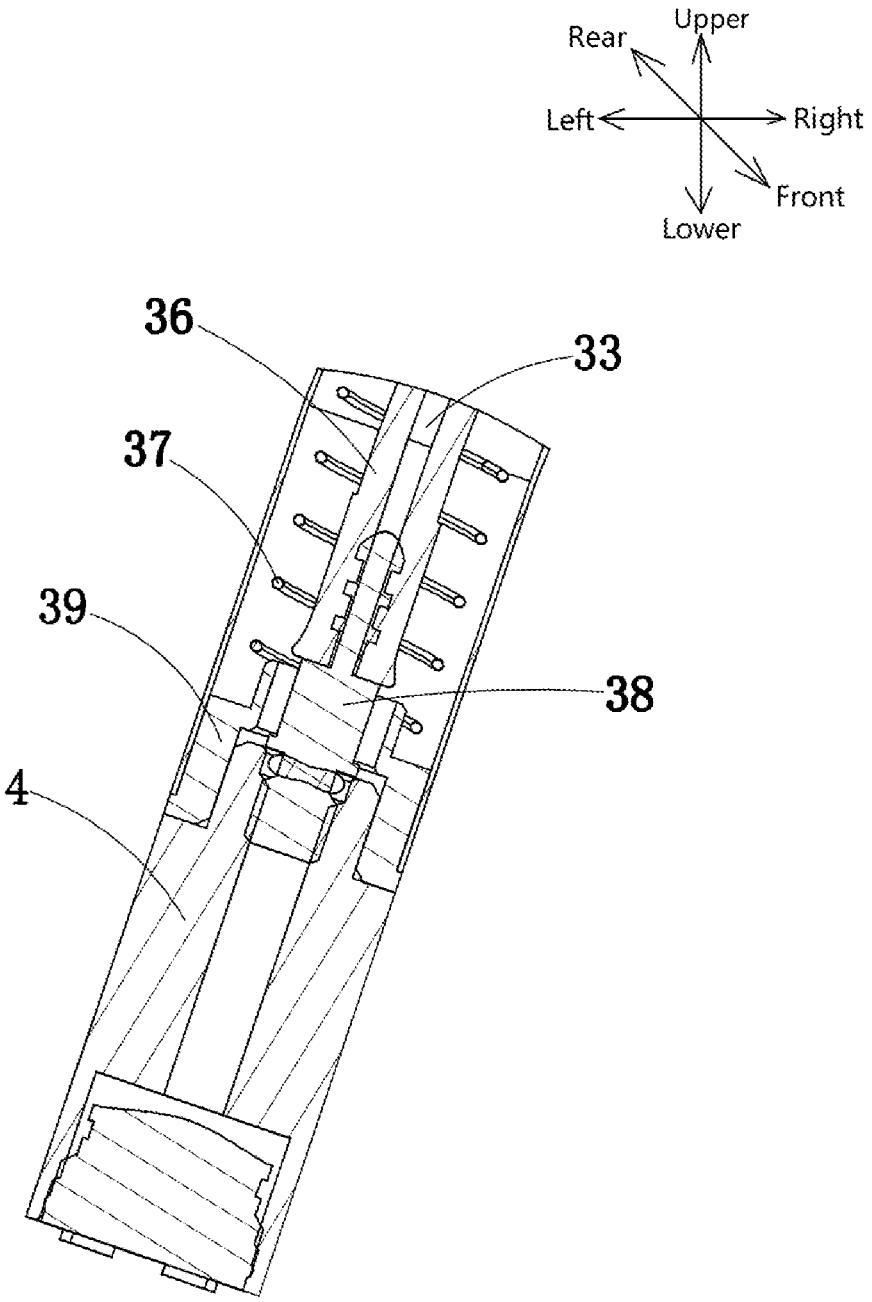
FIG. 4 is an enlarged sectional structural view of part C of a tube-in-tube pull-out faucet.
Figure 5:
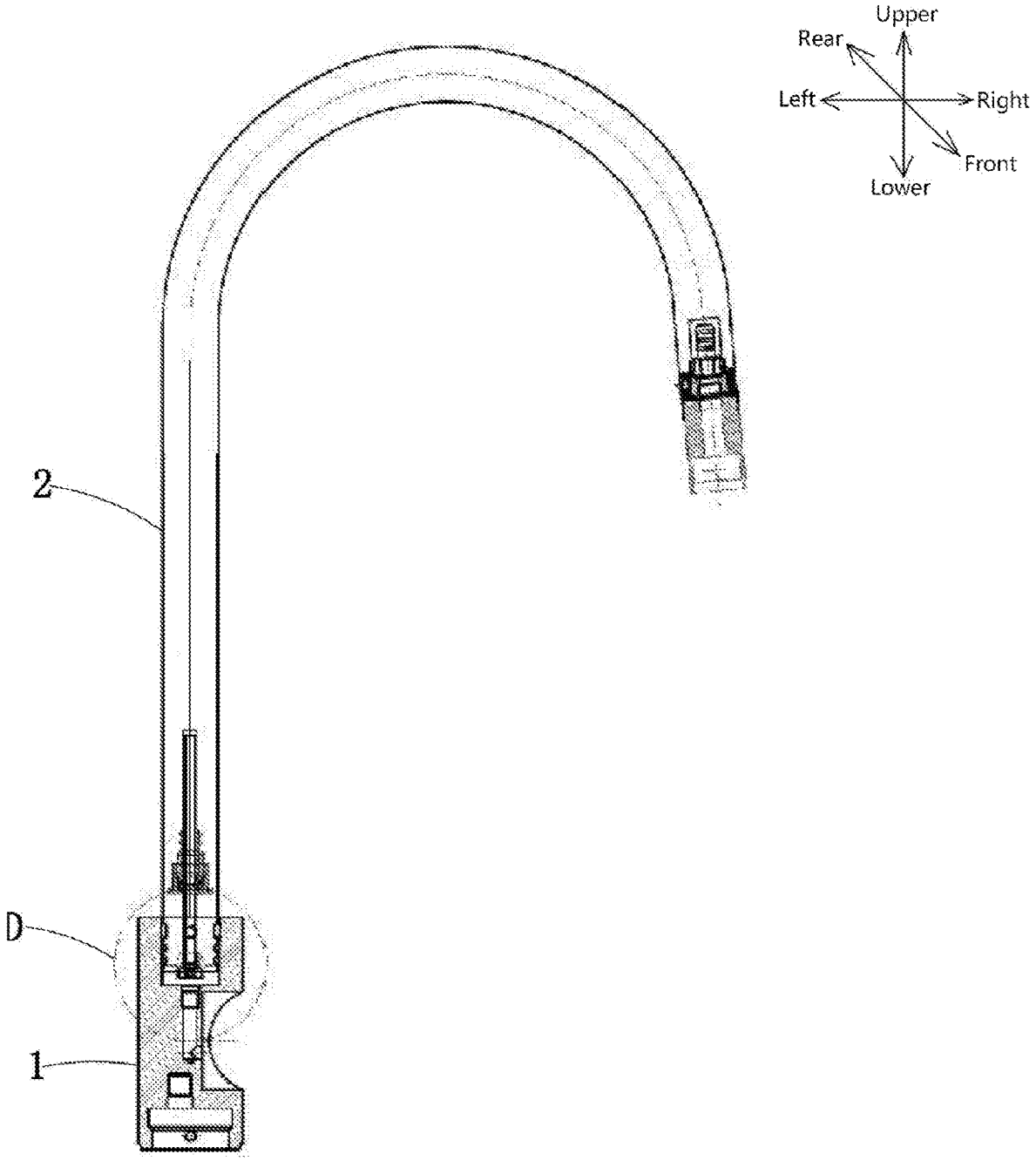
FIG. 5 is a perspective sectional structural view of a part of a tube-in-tube pull-out faucet.
Figure 6:
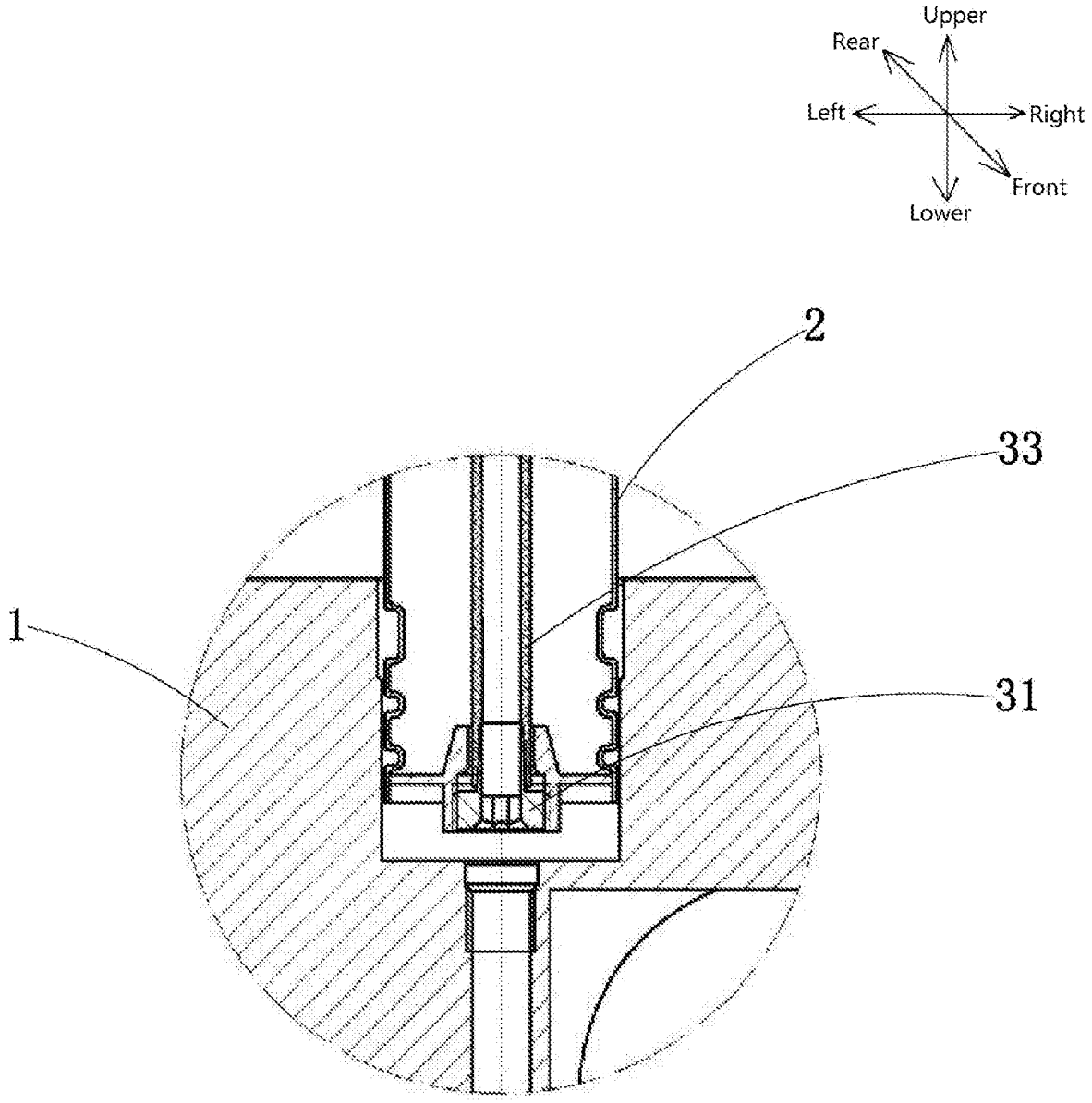
FIG. 6 is an enlarged sectional structural view of part D of FIG. 5.

Further, as shown in FIG. 4, the tube-in-tube pull-out faucet further comprises a first sealing ring 7, a second sealing ring 8 and a third sealing ring 9, wherein the first sealing ring 7 and the third sealing ring 9 are clamped on an inner wall of the outer tube 2 in a spaced manner, and the second sealing ring 8 is sleeved on the inner tube joint nut 32 and located between the first sealing ring 7 and the third sealing ring 9.

Further, the inner tube 33 is made of a polyamide (PA) material (or similar). However, its materials are not limited thereto, and the inner tube 33 may also be made of other materials, e.g. a rigid inner tube 33.

Further, as shown in FIGS. 1, 3 and 4, the outer tube 2, the inner tube 33 and the pull-out tube 36 are U-shaped. However, their shapes are not limited thereto, and it is also possible to provide the outer tube 2 or the inner tube 33 or the pull-out tube 36 with other shapes or in combination.

As described above, the tube-in-tube pull-out faucet involved in the invention has the following beneficial effects:

By utilizing the above tube-in-tube pull-out faucet, compared with the prior art, the invention can reduce the interference with many parts or even difficulty in pulling during pull-out due to no need to pull the inner tube from below the faucet by means of the tube-in-tube pull-out device arranged above the faucet body in combination with the tube-in-tube structure consisting of the outer tube, the pull-out tube and the inner tube, has the advantages of convenience and smoothness in pull-out, a simple structure and low cost, can be replaced as a whole when needed, can be conveniently and quickly repaired with high efficiency after sale, can be rotated by 360 degrees and is convenient to use.

In summary, the invention effectively overcomes various disadvantages in the prior art and has a high industrial application value.

The above embodiments are only used for illustratively describing the principles and effects of the invention, rather than limiting the invention. Any persons skilled in the art can make modifications or changes to the above embodiments without departing from the spirit and scope of the invention. Accordingly, all equivalent modifications or changes made by the persons having ordinary skill in the art without departing from the spirit and technical thought disclosed in the invention still shall be covered by the claims of the invention.

The invention claimed is:

1. A tube-in-tube pull-out faucet having a faucet body and an outer tube fixed to the faucet body, comprising:

a tube-in-tube pull-out device located above the faucet body, wherein the tube-in-tube pull-out device further comprises:

an inner tube;

a first spring bracket;

a stretchable pull-out tube; and a telescopic spring which are disposed in a cavity of the outer tube, wherein the inner tube has a first end passing through a first spring bracket connected to the faucet body; the stretchable pull-out tube has a first end slidably sleeving a portion of the inner tube adjacent the first end of the inner tube in a returned position, and a second end of the pull-out tube is located within the telescopic spring; the telescopic spring has a first end fixed on the first spring bracket, and a second end fixed on the second spring bracket; the pull-out tube is connected to one end of a second pull-out joint via a screwed connection, and another end of the second pull-out joint is connected to a water-discharge head, whereby upon release of the water-discharge head and the pull-out tube from a pulled-out position, the pull-out tube is configured to, via a return force of the telescopic spring, move to the returned position.

2. The tube-in-tube pull-out faucet according to claim 1, further comprising a low-pressure sealing ring and a back-pressure oil seal ring which are sleeved on an outer side wall of the inner tube, wherein the back-pressure oil seal ring is arranged above the low-pressure sealing ring, and the low-pressure sealing ring and the back-pressure oil seal ring are located in the first spring bracket.

3. The tube-in-tube pull-out faucet according to claim 1, further comprising a first sealing ring, a second sealing ring and a third sealing ring, wherein the first sealing ring and the third sealing ring are clamped on an inner wall of the outer tube in a spaced manner, and the second sealing ring is sleeved on the inner tube joint nut and located between the first sealing ring and the third sealing ring.

4. The tube-in-tube pull-out faucet according to claim 1, wherein the inner tube is made of a polyamide (PA) material.

5. The tube-in-tube pull-out faucet according to claim 1, wherein the outer tube, the inner tube and the pull-out tube are U-shaped.

6. The tube-in-tube pull-out faucet according to claim 1, wherein the first spring bracket is connected to the faucet body by using an inner tube joint nut arranged below the first spring bracket, the inner tube joint nut is screwed to one end of an inner tube joint, and another end of the inner tube joint is sleeved by the faucet body.

* * * * *